US006126025A

United States Patent [19]

Recendez M.

[11] Patent Number: 6,126,025

[45] **Date of Patent: *Oct. 3, 2000**

[54] TAMPER-INDICATING PLASTIC CLOSURE HAVING PILFER BAND WITH TABS OF DIFFERENT LENGTHS

[75] Inventor: Luis G. Recendez M., Monterrey, Mexico

[73] Assignee: Fabricas Monterrey, S.A. de C.V., Monterrey, Mexico

[ * ] Notice: This patent issued on a continued prosecution application filed under 37 CFR 1.53(d), and is subject to the twenty year patent term provisions of 35 U.S.C. 154(a)(2).

[21] Appl. No.: 09/016,266

[22] Filed: Jan. 30, 1998

[51] Int. Cl.[7] ..... B65D 41/34

[52] U.S. Cl. ..... 215/252; 215/253; 215/256

[58] Field of Search ..... 215/216, 217, 215/218, 250, 252, 253, 258, 254, 256, 329, 330, 223; 220/266, 268, 276

[56] References Cited

U.S. PATENT DOCUMENTS

| | | | |
|---|---|---|---|
| 4,550,845 | 11/1985 | Guala | 215/252 |
| 4,801,030 | 1/1989 | Barriac | 215/252 |
| 5,004,112 | 4/1991 | McBride | 215/252 |
| 5,007,545 | 4/1991 | Imbery, Jr. | 215/252 |
| 5,251,769 | 10/1993 | Battegazzore | 215/252 |
| 5,450,973 | 9/1995 | Ellis et al. | 215/252 |
| 5,501,349 | 3/1996 | Mccandless | 215/252 |
| 5,657,889 | 8/1997 | Guglielmini | 215/252 |
| 5,749,484 | 5/1998 | Trout | 215/252 |
| 5,779,076 | 7/1998 | Salmon et al. | 215/252 |

*Primary Examiner*—Allan N. Shoap
*Assistant Examiner*—Niki M. Eloshway
*Attorney, Agent, or Firm*—Oblon, Spivak, McClelland, Maier & Neustadt, P.C.

[57] ABSTRACT

A tamper-indicating plastic closure for a container having an annular locking ring includes a closure part cap and a pilfer band connected to the closure part at a frangible connection. A plurality of circumferentially spaced substantially rigid tabs extend generally inwardly from an inner surface of the pilfer band, and the length of at least one of the tabs is shorter than the length of the remaining ones of the tabs. The tabs have lengths sufficient to engage the annular locking ring to provide tamper-indication when the closure part is removed from the container, and the length of the shorter tabs is sufficiently less than the length of the remaining ones of the tabs that the shorter tabs are not permanently deformed by the locking ring when the closure is applied to the container. The pilfer band preferably has at least one weakened region, and the shorter tab is positioned adjacent the weakened region.

12 Claims, 2 Drawing Sheets

TAMPER-INDICATING PLASTIC CLOSURE HAVING PILFER BAND WITH TABS OF DIFFERENT LENGTHS

BACKGROUND OF THE INVENTION

1. Field of the Invention

The present invention relates generally to tamper-indicating closures for containers, and more particularly to a tamper-evident plastic closure including a pilfer band having container-engaging projections or tabs to facilitate application of closure to a container with high-speed application equipment.

2. Description of the Related Art

Tamper-indicating or tamper-evident container closures are well-known. For example U.S. Pat. No. 4,938,370 to McBride, which is hereby incorporated by reference in its entirety, discloses tamper evident plastic closures for use in connection with bottles or like containers having a threaded neck and a locking ring. The tamper evident function is there provided by a pilfer band which is initially attached to the closure cap via a score line, but which breaks or separates from the closure cap and remains on the bottle when the closure cap is unscrewed or otherwise removed from the bottle for the first time. The pilfer band includes tabs or projections which engage the threads or locking ring of the bottle so as to resist the removal of the pilfer band. The tabs must be capable of permitting passage of the threads and locking ring as the closure is applied to the bottle in conventional high speed application equipment, but must nonetheless reliably retain the pilfer band on the bottle when the cap is removed for the first time by the consumer. For this purpose, the tabs of McBride are flexible tabs which are capable of pivoting into either of two modes of tamper indication.

It is also known to provide the pilfer band with a weakened region in the form of a vertical line of reduced thickness which may be molded into the plastic closure. The presence of the weakened region results in a preferential failure of the pilfer band at the weakened region due to hoop stresses so that the pilfer band breaks and does not fully separate from the closure cap when the closure cap is first removed from the bottle. The pilfer band therefore remains with the closure cap, which is desirable for use with returnable bottles. Although not shown in McBride, such a weakened region can also be incorporated into the pilfer bands of closures based upon this patent.

More recently, there has been developed a tamper indicating plastic closure whose pilfer band has rigid tabs which do not pivot into the two different modes of tamper indication. However it has been found that the tabs adjacent the weakened region may break or permanently deform upwardly against the interior wall of the pilfer band during the application of the closure to a container or bottle using high speed application equipment. Those tabs which are so bent may be unable to participate in the subsequent retention of the pilfer band on the bottle during the removal of the closure cap. Reliable tamper indication might therefore be impaired.

SUMMARY OF THE INVENTION

It is an object of the present invention to overcome the aforementioned shortcomings of the conventional tamper indicating plastic closures.

It is a further object of the invention to provide a tamper indicating plastic closure having a pilfer band which can reliably indicate the presence of tampering.

It is yet a further object of the invention to provide a tamper indicating plastic closure having a pilfer band with substantially rigid tabs, at least some of which are shorter in length than the remaining tabs.

According to one aspect of the invention, the above and other objects are achieved by a tamper-indicating plastic closure for a container having an annular locking ring, in which the closure comprises a closure part cap and a pilfer band connected to the closure part at a frangible connection. A plurality of circumferentially spaced substantially rigid tabs extend generally inwardly from an inner surface of the pilfer band, and the length of at least one of the tabs is shorter than the length of the remaining ones of the tabs.

The tabs have lengths sufficient to engage the annular locking ring to provide tamper-indication when the closure part is removed from the container, and the length of the shorter tabs is sufficiently less than the length of the remaining ones of the tabs that the shorter tabs are not plastically deformed by the locking ring when the closure is applied to the container.

The pilfer band preferably has at least one weakened region, and the shorter tab is positioned adjacent the weakened region.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
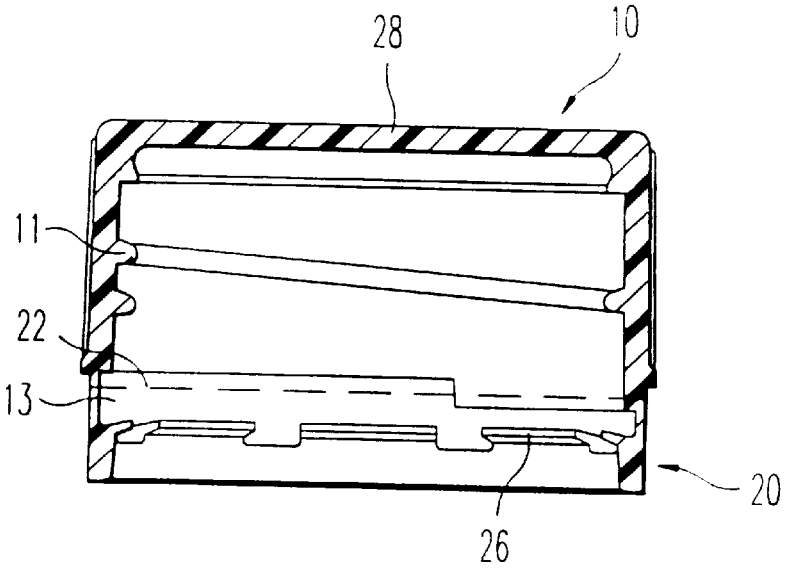
FIG. 1 is a sectional view of a tamper indicating plastic closure according to the invention.

The closure according to the invention is formed of a conventional plastic and can be made by various conventional injection molding or compression molding techniques. It includes a closure part 10 and a pilfer band 20. The closure part 10 is conventional and substantially corresponds to that described in U.S. Pat. No. 4,938,370. It includes threads 11 which cooperate with threads on the exterior of the mouth portion of a bottle (not shown) to retain the closure part on the bottle and seal the mouth of the bottle. The pilfer band 20 is also conventional and substantially corresponds to that shown in U.S. Pat. No. 4,938,370, except as noted below. The pilfer band is connected to the closure part 10 by a conventional frangible connection 22 in the form of a score line which may be made in a conventional manner. As is well known, the bottle normally has a locking ring (not shown) which is positioned in the reduced thickness annular region 13 of the pilfer band when the closure is mounted onto the mouth portion of the bottle.

The pilfer band has a conventional weakened region 24 which takes the form of a vertical line of reduced thickness, in order that the pilfer band will preferentially break or separate at this weakened region so that the pilfer band 20 does not fully separate from the closure part 10 at the frangible connection 22 when the closure part is removed from the bottle, which is desirable for use with returnable bottles. The vertical line of reduced thickness may be molded into the pilfer band or formed by a cut.

A circumferentially aligned plurality of projections or tabs 26 are formed on the inner peripheral surface of the pilfer band and extend generally inwardly and upwardly, i.e., toward the top 28 of the closure part. The tabs 26 are preferably integrally molded with the pilfer band 20 and are intended to be substantially rigid and to engage the underside of the locking ring to cause a separation at the frangible connection 22 which prevents the pilfer band 20 from being removed from the bottle, or to cause the pilfer band to break at the weakened region 24, when the closure part is first removed (e.g., unscrewed) from the bottle. The tabs 26 must be sufficiently short to permit the passage of the threads and the locking ring of the bottle as the closure is being applied to the bottle using high speed application equipment. On the other hand, they must be sufficiently long and rigid to adequately grip the locking ring and prevent an unbroken pilfer band 20 from being removed from the bottle together with the closure part 10.

Figure 2:
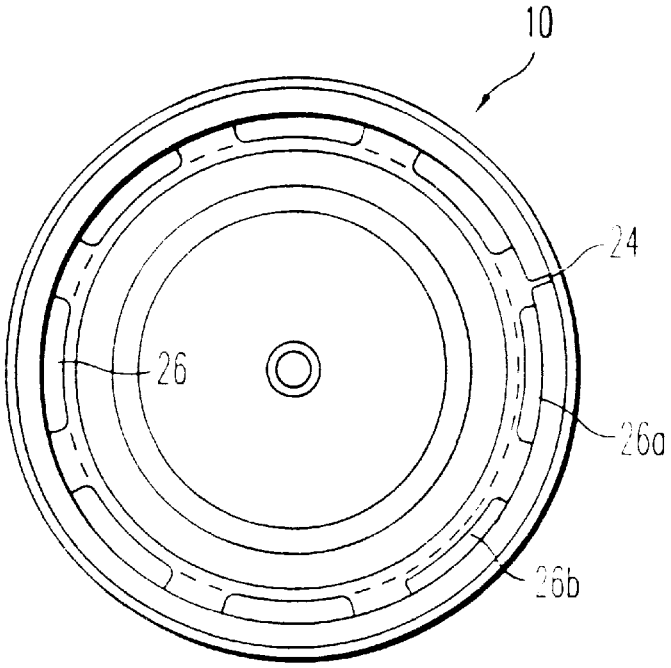
FIG. 2 is a bottom plan view of a tamper indicating plastic closure according to the invention.
Figure 3:
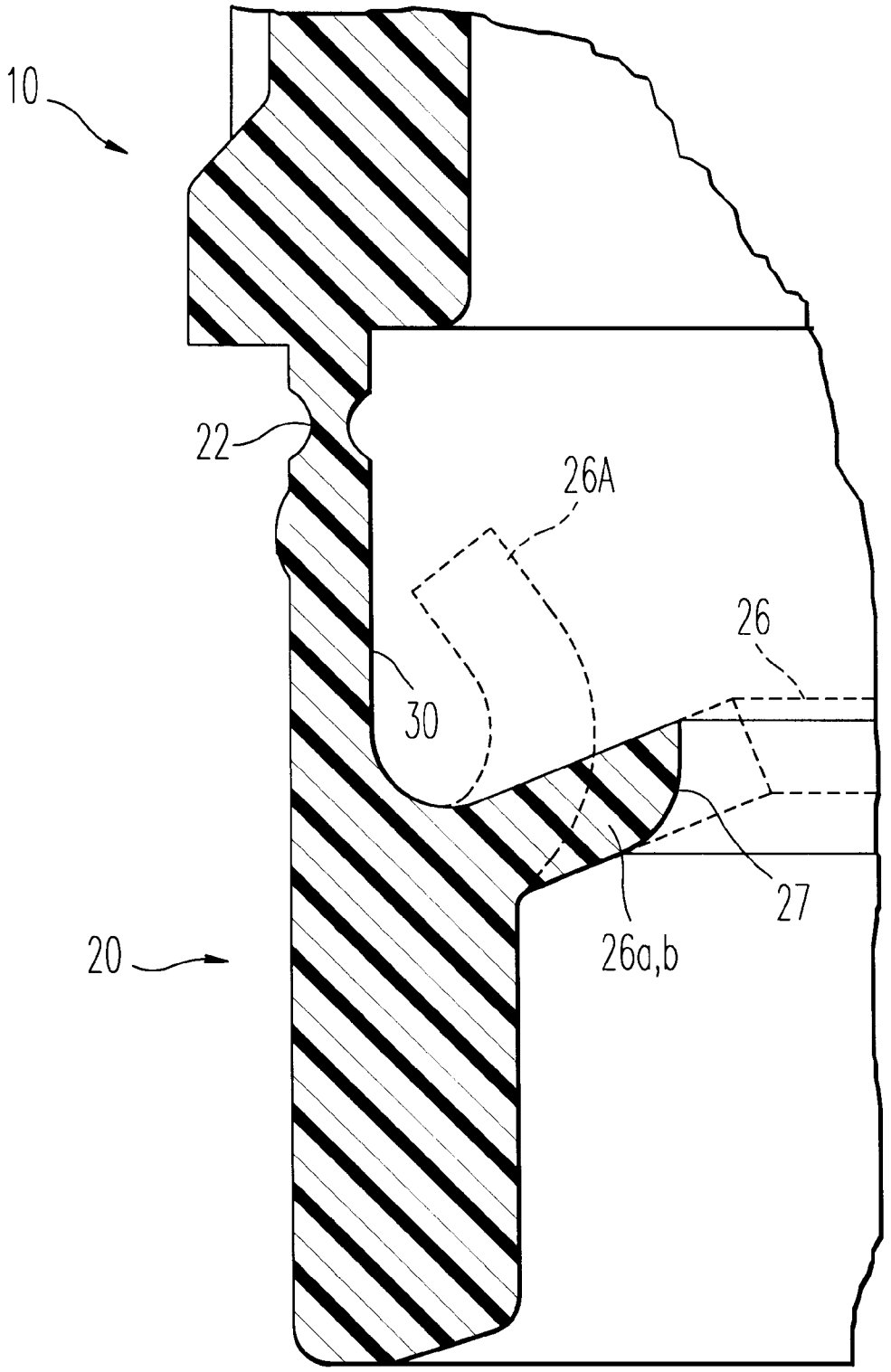
FIG. 3 is detail of the tamper indicating plastic closure of FIG. 1, illustrating the shortened tabs according to the invention.

Nonetheless, it has been found that if tabs 26 of equal length are made sufficiently long to function for retaining the unbroken pilfer band 20 on the bottle during the removal of the closure, at least some of the tabs, typically the two tabs 26*a* and 26*b* adjacent the weakened region 24 (in the clockwise direction as viewed in FIG. 2) may be plastically or permanently deformed and pressed against the inner surface 30 of the reduced thickness annular region 13 of the pilfer band during the application of the closure to the mouth of the bottle by high speed automated equipment, as shown in dashed lines at 26A in FIG. 3. Since the tabs 26*a* and 26*b* are thereby permanently deformed, they cannot subsequently engage the locking ring of the bottle to contribute to the retention of the pilfer band 20 on the bottle during removal of the closure part 10, and so the reliability of the tamper indicating function may be impaired.

Applicants have found that this problem of permanent deformation of the tabs 26*a* and 26*b* can be substantially eliminated by shortening the length of the tabs 26*a* and 26*b*, as compared to the remaining tabs 26 (whose length is shown in dash lines in FIG. 3), for example by 0.5 mm. It has been found that by so shortening the tabs 26*a* and 26*b*, they are prevented from being permanently deformed during the application of the closure to the bottle, while the tabs remain capable of reliably retaining the unbroken pilfer band on the bottle during the removal of the closure part 10, in order to provide tamper indication.

The distal ends of the shortened tabs 26*a* and 26*b* may also have radiussed lower edges, as shown at 27 in FIG. 3. This further reduces the resistance of the shortened tabs 26*a*, 26*b* to the passage of the locking ring of the bottle, and permits a greater weakening of the pilfer band at the weakened region 24.

Obviously, additional modifications and variations of the present invention are possible in light of the above teachings. It is therefore to be understood that within the scope of the appended claims, the invention may be practiced otherwise than as specifically described herein.

What is claimed is:

1. A tamper-indicating plastic closure for a container having an annular locking ring, comprising:

a closure part;

a pilfer band connected to the closure part at a frangible connection and having at least one weakened region; and a plurality of circumferentially spaced tabs having lengths extending generally inwardly from an inner surface of said pilfer band and being sufficiently rigid that said tabs do not pivot into two different modes of tamper indication, wherein the length of at least two of said tabs positioned adjacent to, and on the same side as, the weakened region is shorter than the length of remaining ones of said tabs, and wherein the remaining ones of said tabs have the same length.

2. The tamper-indicating plastic closure of claim 1, wherein said tabs have lengths sufficient to engage the annular locking ring to provide tamper-indication when the closure part is removed from the container, and wherein the length of the at least one of said tabs is sufficiently shorter than the length of the remaining ones of said tabs that said at least one of said tabs is not substantially permanently deformed by the locking ring when the closure is applied to the container.

3. The tamper-indicating plastic closure of claim 1, wherein the length of said two tabs is 0.5 mm shorter than the length of the remaining ones of said tabs.

4. The tamper-indicating plastic closure of claim 1, wherein there are eight of said tabs.

5. The tamper-indicating plastic closure of claim 1, wherein said closure part is threaded.

6. The tamper-indicating plastic closure of claim 1, wherein said pilfer band has exactly one weakened region.

7. A tamper-indicating plastic closure for a container having an annular locking ring, comprising:

a threaded plastic closure part having a top and side walls;

a pilfer band molded unitarily with said closure part and connected to the side walls of the closure part at a frangible connection; and a plurality of circumferentially spaced tabs having lengths extending generally radially inwardly from an inner surface of said pilfer band and toward the top of the closure part and being sufficiently rigid that said tabs do not pivot into two different modes of tamper indication, wherein the length of two of said tabs is shorter than the length of remaining ones of said tabs, wherein said tabs have lengths sufficient to engage the annular locking ring to provide tamper-indication when the closure part is removed from the container, and wherein the length of said two of said tabs is sufficiently shorter than the length of the remaining ones of said tabs that said two of said tabs are not substantially permanently deformed by the locking ring when the closure is applied to the container.

8. The tamper-indicating plastic closure of claim 7, wherein said pilfer band has a weakened region, and wherein the two tabs are positioned adjacent to, and on the same side of, the weakened region.

9. The tamper-indicating plastic closure of claim 8, wherein the remaining ones of said tabs have the same length.

10. The tamper-indicating plastic closure of claim 1, wherein the length of said two tabs is 0.5 mm shorter than the length of the remaining ones of said tabs.

11. The tamper-indicating plastic closure of claim 7, wherein a lower edge of the distal end of said at least one of said tabs is radiussed.

12. A tamper-indicating plastic closure for a container having an annular locking ring, comprising:

a closure part;

a pilfer band connected to the closure part at a frangible connection and having at least one weakened region; and a plurality of circumferentially spaced tabs having lengths extending generally inwardly from an inner surface of said pilfer band and being sufficiently rigid that said tabs do not pivot into two different modes of tamper indication, wherein the length of at least one of said tabs positioned adjacent to the weakened region is shorter than the length of remaining ones of said tabs, and wherein a lower distal end of said at least one of said tabs is radiussed.

* * * * *